US006640514B2

(12) United States Patent
Guibert et al.

(10) Patent No.: US 6,640,514 B2
(45) Date of Patent: Nov. 4, 2003

(54) MODULAR WALL OR DOUBLE WALL ELEMENT FOR DRY ASSEMBLY

(76) Inventors: Jérome Guibert, 13, rue des Rouges Gorges, F-30100 Ales (FR); Jean-Yves Moulin, 13, rue des Rouges Gorges, F-30100 Ales (FR)

( * ) Notice: Subject to any disclaimer, the term of this patent is extended or adjusted under 35 U.S.C. 154(b) by 0 days.

(21) Appl. No.: 09/819,076

(22) Filed: Oct. 25, 2001

(65) Prior Publication Data

US 2002/0152710 A1 Oct. 24, 2002

Related U.S. Application Data

(63) Continuation of application No. 09/623,216, filed on Aug. 30, 2000.

(51) Int. Cl.[7] ..... E04B 2/46

(52) U.S. Cl. ..... 52/592.1; 52/604; 52/605; 52/606

(58) Field of Search ..... 52/589.1, 590.1, 52/590.2, 592.1, 603, 604, 605, 606

(56) References Cited

U.S. PATENT DOCUMENTS 3,478,482 A * 11/1969 Weir ..... 52/603
4,038,798 A * 8/1977 Sachs ..... 52/309.7
4,566,235 A * 1/1986 Groll ..... 52/220
5,379,565 A * 1/1995 Vienne ..... 52/606
6,122,881 A * 9/2000 Aubertot ..... 52/604
6,226,951 B1 * 5/2001 Azar ..... 52/604

FOREIGN PATENT DOCUMENTS

WO WO 80/02301 * 4/1979 ..... 52/606

* cited by examiner

*Primary Examiner*—Carl D. Friedman
*Assistant Examiner*—Naoko Slack
(74) *Attorney, Agent, or Firm*—Connolly Bove Lodge & HTZ LLP

(57) ABSTRACT

The invention concerns a modular wall or double wall element (S) for dry assembly characterized in that some at least (1*a*, 1*b*, 31*a*, 31*b*) of its faces arranged to co-operate with adjacent modular elements have contact parts (2*a*, 2*b*; 32*a*, 32*a*, ' 32*b*, 32*b*′) designed to be pressed against said adjacent modular elements, and separating parts (3*a*, 3*a*′, 3*b*, 3*b*′ 33*a*′, 33*b*) arranged to remain separated by a clearance of said adjacent modular elements, said clearance being sufficiently large to limit, even eliminate, infiltration of water by capillary action. The invention is applicable to the field of construction building.

5 Claims, 3 Drawing Sheets

MODULAR WALL OR DOUBLE WALL ELEMENT FOR DRY ASSEMBLY

This application is a continuation of U.S. application Ser. No. 09/623,216 filed Aug. 30, 2000.

The present invention relates to a modular wall or double wall element for dry assembly In the building industry, it is known to provide walls or double walls comprising, firstly, a structural part designed to be situated inside the building and, secondly, a facing part intended to be placed on the outside of the building.

Conventionally, the structural part is made up from reinforced concrete or building blocks and the outer facing part is made from a covering of small bricks, stones or similar. While the structural part is designed to be covered, inside the building, with a finishing consisting for example of plaster or plasterboard, the outer facing part is designed to be seen from outside.

Depending on the particular case, an insulating space can be provided between the structural and facing parts, for receiving layers of fiberglass or another insulating material.

Even if it remains true that double walls constitute a rational solution which is completely adapted to the requirements of the building industry, the fact nevertheless remains that their cost and implementation cost are relatively high.

To reduce costs, various solutions for modular walls or double walls have been proposed in the past.

Some of these solutions consist in modular elements shaped to fit into each other in the dry state, in other words without using mortar or some other similar bonding means. These solutions allow faster building and the use of relatively unskilled labour, thereby reducing the cost of buildings.

This said, eliminating physical joints between the modular elements does create a certain number of problems including the problems of air- and water-tightness.

A problem with air-tightness can easily be overcome by for example covering the face of a modular wall or double wall located towards the inside of the building with a plaster or plasterboard covering.

Problems of water-tightness are, on the other hand, much more difficult to resolve and the situation currently is that no wall or double wall modular element for dry assembly available on the market can resolve this problem of sealing in a satisfactory manner.

The principal aim of the present invention is to provide a wall or double wall modular element for dry assembly that makes it possible to obtain walls or double walls that are watertight without the need to add any protection whatsoever.

This aim, as well as other aims which will become apparent from the description that follows, is achieved, according to the invention by a modular element for a wall or double wall for dry assembly, wherein at least some of its faces designed to co-operate with adjacent modular elements have contact portions designed to be applied against said adjacent modular elements, and separation portions designed to remain separated by a clearance from said adjacent modular elements, said clearance being sufficiently large to limit or even eliminate infiltration of water by capillarity.

According to other characteristics of the invention:

the upper and lower faces of the modular element each have at least one contact portion taking the form of a substantially flat land and a separation portion respectively shaped in the form of a longitudinal projection and in the form of a longitudinal channel defining a mutual interfitting arrangement, said flat lands being designed to provide vertical transfer of loads through said modular element and said longitudinal projection and longitudinal channel being designed to limit or even eliminate horizontal infiltration of water by capillarity as well as ensuring guiding of said modular element during assembly and maintaining it in place once assembled, and forming a mechanical barrier to dynamic horizontal infiltration of water and air, said longitudinal projection and channel have, moving from the outside towards the inside of said modular element, at least one flank which is inclined with respect to the vertical, a horizontal flank and a vertical flank, said inclined flank makes an angle of about. 30° with respect to the vertical, the modular element comprises at least one hollow extending between the flat lands of its upper and lower faces in order to oblige possible infiltration of water to run vertically as well as to lighten said modular element, said upper face carries at least one horizontal groove extending along its length and communicating with said hollow, in order to constitute a supplementary obstacle to horizontal infiltration of water and to channel the latter towards said hollow, said horizontal groove is adjacent to said longitudinal projection, in order to stop possible water infiltration as close as possible to the outside of said modular element, the cumulative transverse extension of said longitudinal projection and of said horizontal groove is substantially equal to the transverse extension of said longitudinal channel, the cross section of said hollow decreases towards the base of the said modular element in order to facilitate mold release thereof during manufacture and to provide a sloping path for passage downwards of water, said hollow has a substantially rectangular shape with rounded corners in order to obviate the presence of areas where breakage can start, the radius of curvature of the corners of said hollow is greater than 35 mm, the modular element has two hollows arranged so as to be able to constitute water evacuation channels in a straight or horizontally staggered stack, and to possibly allow the placing of vertical anchorage members, said two hollows are separated by an intermediate cavity communicating with the said horizontal groove, in order to allow more homogeneous compacting of the material constituting said modular element during manufacture, and in order to form a supplementary water evacuation passage, the side faces of a modular element designed to co-operate with adjacent modular elements each have at least one substantially flat land and a zigzag-shaped portion defining a mutually mating interfitting arrangement, in order to ensure guiding of said modular element at the time of assembly, to maintain it in place once assembled, and to form a mechanical barrier against dynamic vertical infiltration of water and air, said flat lands constitute contact portions, said zigzag-shaped portions constitute separation portions defining a clearance designed to limit or even eliminate vertical infiltration of water by capillarity, said side faces include horizontal grooves extending over the full height thereof in order to form a supplementary obstacle to vertical infiltration of water and to channel infiltrated water towards the base of said modular element, the modular element is shaped whereby said clearance between separation portions is at least equal to 2 mm, at least the upper horizontal edge of said modular element designed to be placed facing outwards is shaped so as to render the horizontal line of join between two stacked modular elements visible, one at least of its vertical edges designed to face outwards is shaped so as to render the line of join between two adjacent modular elements visible.

the modular element carries a U-shaped cavity or L-shaped cavity extending between its upper and lower faces, in order to form an anchoring modular element, the side faces of said modular element designed to be placed against adjacent modular elements are oriented substantially perpendicularly with respect to each other, in order to form a corner modular element, said modular element is reversible, in other words substantially symmetrical with respect to a vertical axis passing through its center of gravity, in order to form a standard modular element.

the modular element is in waterproof concrete to avoid impregnation by water.

Thanks to these characteristics, a modular element is obtained making it possible to build walls or double walls dry, while including watertightness-providing barriers that are physical (clearance preventing infiltration by capillarity), mechanical (a geometry that prevents dynamic infiltration of water), and chemical (waterproof concrete avoiding infiltration by impregnation). Such walls or double walls are completely watertight so that any supplementary protection means can be dispensed with.

Further characteristics and advantages of the invention will become more clear from the description that follows in association with the attached drawings.

Figure 1:
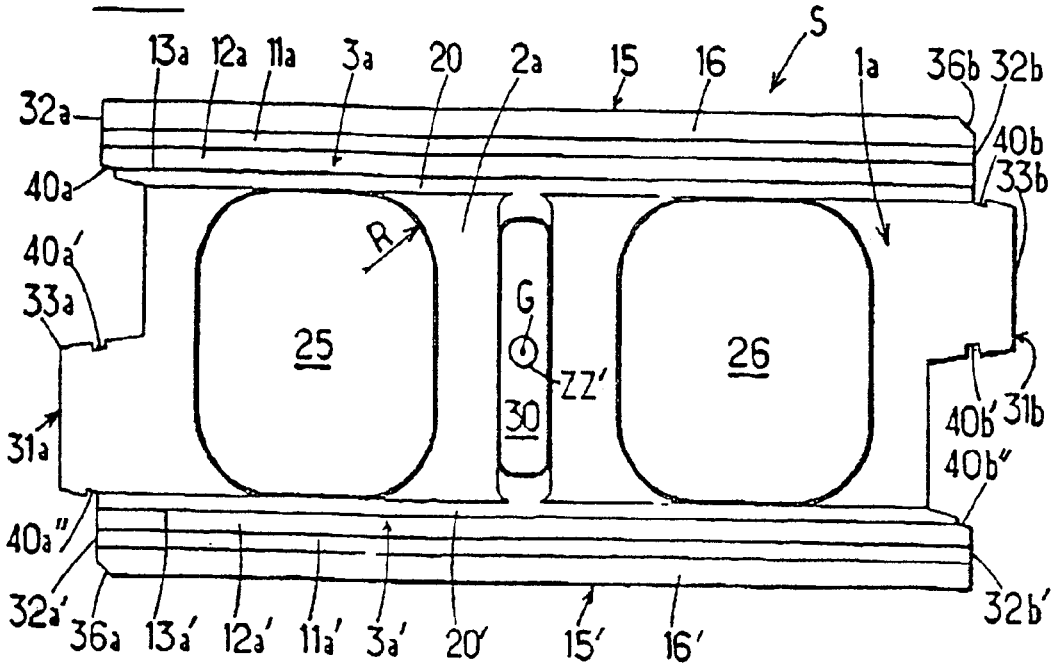
FIG. 1 is a top view of a standard modular element according to the invention.

In the drawings, identical numerical references identify parts or assemblies thereof that are identical or similar.

Figure 3:
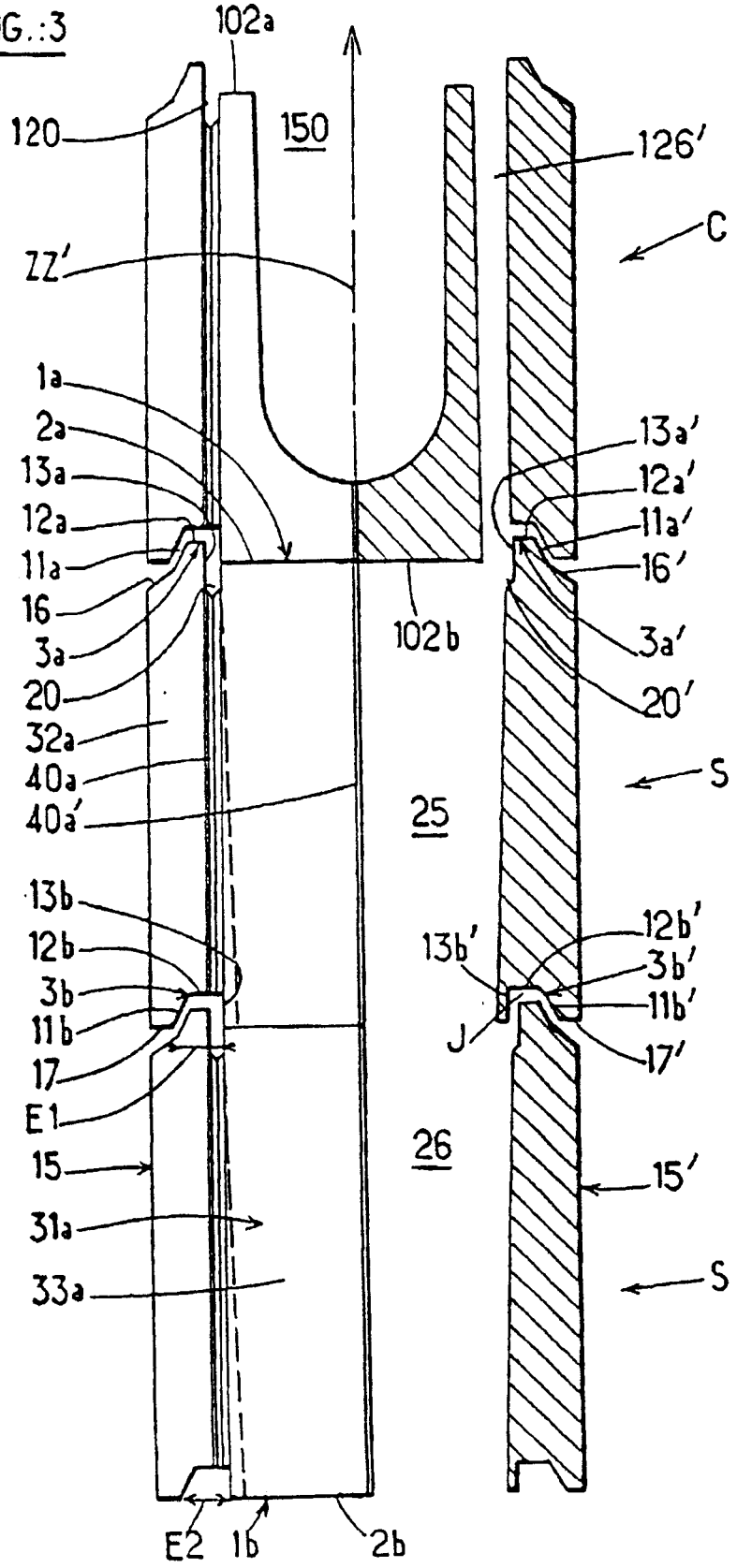
FIG. 3 is a side half-view and a vertical half-cross section of a stack of two standard modular elements and one U-shaped modular element for anchoring means according to the invention.
Figure 4:
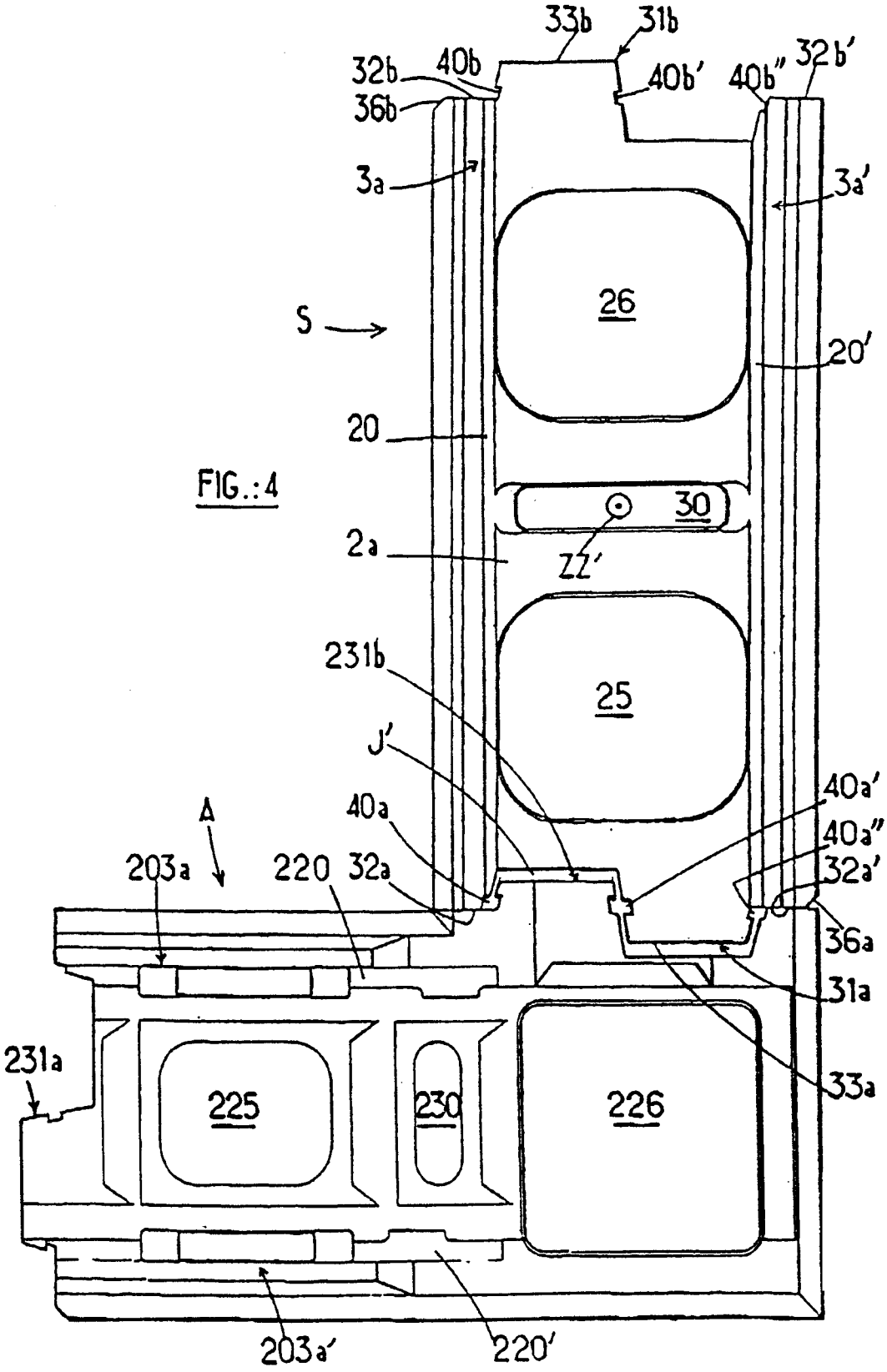
FIG. 4 is a top view of the interfitting of a standard modular element and a left-hand angle modular element according to the invention.

Turning now to FIGS. 1, 3 and 4, there can be seen a standard modular element S according to the invention shown respectively alone, stacked with other modular elements S, C according to the invention and interfitted with a left-hand corner modular element A according to the invention.

This standard modular element S has a substantially parallelepiped shape and is reversible, in other words is symmetrical with respect to an axis ZZ' passing through its center of gravity G, and is designed to be positioned so that this axis is vertical (see FIG. 1).

Its upper face has a substantially flat land 2*a* bordered by two longitudinal projections 3*a*, 3*a'* extending over the whole length thereof.

Each of these longitudinal projections has, moving from the outside towards the inside of the modular element, an inclined flank 11*a*, 11*a*', a horizontal flank 12*a*, 12*a*' and a vertical flank 13*a*, 13*a'*.

The inclined flanks 11*a*, 11*a*' preferably make an angle of about 30° with respect to the vertical.

These longitudinal projections are connected to outer faces 15, 15' by optional chamfers 16, 16' formed in the upper horizontal edges of the modular element.

The optional chamfers 16, 16' preferably make an angle of about 45° to the vertical.

The lower face 1*b* of modular element S has a substantially flat central land 2*b* bordered by two longitudinal channels 3*b*, 3*b*' defining a complementary mating arrangement with the longitudinal projections 3*a*, 3*a*' (see FIG. 3).

Each one of these longitudinal channels consequently has, moving from the outside towards the inside of the modular element, an inclined flank 11*b*, 11*b*', a horizontal flank 12*b*, 12*b*' and a vertical flank 13*b*, 13*b'*.

These longitudinal channels are connected to the outer faces 15, 15' by horizontal flanks 17, 17' located in the same plane as land 2*b*.

The upper 1*a* and lower 1*b* faces are shaped whereby, when the two modular elements are stacked one the upon the other, their flat lands are applied one against the other, while their longitudinal projections and channels are separated by a clearance J, preferably at least equal to 2 mm.

The upper face 1*a* of modular element S also carries two horizontal grooves 20, 20' in line with the vertical flanks 13*a*, 13*a*' and extending over the whole length of the modular element.

The cumulative transverse extension E1 of a longitudinal projection 3*a*, 3*a*' and an adjacent horizontal groove 20, 20' is substantially equal to the transverse extension E2 of a channel 3*b*, 3*b'*.

Modular element S further comprises two hollows 25, 26 which extend between the lands 2*a* and 2*b*, and the upper portion of which communicates with the horizontal grooves 20, 20'.

These hollows have a substantially square cross section with rounded corners, the radius of curvature R of the corners being preferably greater than 35 mm (see FIG. 1).

Additionally, as can be seen on FIG. 3 where the vertical half-cross sections of these hollows can be seen, their cross section decreases towards the base of the modular element.

The two hollows 25, 26 are separated by an intermediate cavity 30 of substantially parallelepiped shape which also extends between the lands 2*a*, 2*b* and of which the upper portion also communicates with the horizontal grooves 20, 20' (see FIG. 1). Like the hollows 25, 26, the cross section of this cavity decreases towards the base of the modular element.

The side faces 31*a*, 31*b* of the modular element S designed to co-operate with adjacent modular elements each have two flat lands 32*a*, 32*a*', 32*b*, 32*b*' bordering a central portion having a zigzag shape 33*a*, 33*b*.

One of these two lands, 32*a*', 32*b* of each face is connected to an adjacent outer face 15', 15 by an optional chamfer 36*a*, 36*b* formed in a vertical edge of the modular element.

The faces 31*a*, 31*b* define a mutual interfitting arrangement, and these faces are preferably shaped so that, when two modular elements according to the invention are fitted one into the other, their lands are applied one against the other, while their zigzag portions are separated by a clearance J' preferably of at least 2 mm (see FIG. 4).

The zigzag portions 33*a*, 33*b* each include three vertical grooves 40*a*, 40*a*', 40*a*" and 40*b*, 40*b*', 40*b*" extending over their full height, these grooves being positioned so as to locate facing the grooves of adjacent modular elements.

Figure 2:
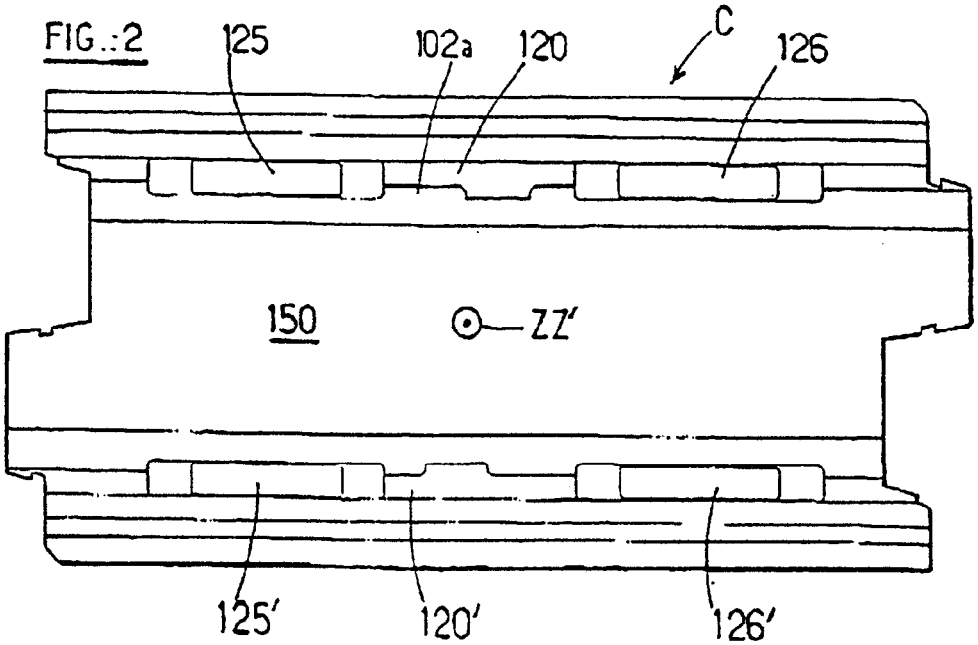
FIG. 2 is a top view of a u-shaped modular element for anchorage means according to the invention.

Turning now to FIGS. 2 and 3, FIG. 2 shows a U-shaped modular element C for anchorage means according to the invention and FIG. 3 shows such a modular element stacked on two standard modular elements S.

This modular element for anchorage means has the same characteristics as a standard modular element with the following slight differences.

It includes a downwardly-open U-shaped cavity 150 extending over the whole length of the modular element between upper land 102*a* and lower land 102*b* (see FIG. 2).

Two pairs of narrow hollows 125, 125' and 126, 126' extending between the lands 102*a* and 102*b* are situated at each side of U-shaped cavity 150. The upper portions of these hollows communicate with horizontal grooves 120, 120'.

We shall now discuss FIG. 4 on which a left-hand corner modular element again according to the invention is shown mated with a standard modular element S.

This corner modular element has the same characteristics as a standard modular element (it comprises, notably, two hollows 225, 226 and an intermediate cavity 230), with several slight differences discussed below.

The longitudinal projections 203*a*, 203*a'*, the longitudinal channel located at the inside of the angle (not shown) and the horizontal grooves 220, 220' only extend over about half the length of the modular element.

The side faces 231*a*, 231*b* designed to be located against adjacent modular elements are oriented substantially perpendicularly with respect to each other.

The modular elements described above can be made by molding using a whole range of materials currently employed in the construction field. Preferably, architectural grade concrete (in other words satisfying certain aesthetic criteria such as color, texture, and so on) and that is waterproof, is employed.

The practical implementation and advantages of the modular shuttering element according to the invention will become evident directly from the above description.

To provide a wall, the first step consists in placing a first row of modular shuttering elements on perfectly horizontal ground, obtained, for example, with a concrete platform (not shown).

The modular shuttering elements are interfitted one into the other using the mating profiles on their side faces.

Standard modular shuttering elements are employed for the portions that run in a straight line, left or right hand-angled modular shuttering elements for the corners.

Having laid the first row of modular shuttering elements, a second layer of modular shuttering elements can be laid so as to form a straight stack in other words without any horizontal offset between the two rows, or staggered, in other words with adjacent rows offset horizontally by a half-length of one modular shuttering element.

Guiding and correct positioning of the modular shuttering elements of the second row is ensured by the longitudinal channels 3*b*, 3*b'*, which co-operate with the longitudinal projections 3*a*, 3*a'*, 203*a*, 203*a'* of the modular shuttering elements of the first row.

By repeating these operations as many times as is necessary, a wall or double wall having the desired height can be constructed.

The straight or staggered stacking of rows of modular elements has the effect of vertically aligning their hollows 25, 26, 225, 226. Some of the passages thus created can now be used for putting in place a vertical anchorage which can for example consist of reinforced concrete posts or vertical metal beams distributed at regular horizontal intervals.

Rows of anchoring modular elements placed at regular vertical intervals additionally make it possible, thanks to the channels formed by the alignment of the U-shaped cavities of these elements, to connect vertical anchoring members together thereby providing horizontal anchoring.

The properties of vertical and horizontal interfitting of the modular elements and the anchoring thus achieved makes it possible to provide walls and double walls which are extremely strong, which can notably withstand forces perpendicular to their plane.

Transfer of vertical loads occurs solely between the upper lands 2*a*, 102*a* and lower lands 2*b*, 102*b* given the geometrical characteristics described above. To avoid all danger of cracking, it is essential that these lands be perfectly flat.

Additionally, the risks of cracking associated with transfer of vertical loads is further limited thanks:

- to the rounded shape of the corners of hollows 25, 26, 225, 226 obviating points where breakage can start,
- to the tapering of these hollows towards the base of the modular elements making it possible to obtain, during production, mold release without material being torn off which could weaken the modular elements,
- to the intermediate cavities 30, 230 making it possible to provide, during manufacture, more homogeneous compacting of the material constituting the modular elements thereby avoiding stresses subsequently becoming concentrated in certain areas of the modular elements.

Apart from the fact that the modular element according to the invention offers remarkable simplicity of implementation and robustness, it further makes it possible to resolve problems of sealing conventionally associated with modular walls or double walls mounted dry.

Indeed, the mutual interfitting of the projections 3*a*, 3*a'*, 203*a*, 203' and channels 3*b*, 3*b'* on the one hand, and the zigzag-shaped portions 33*a*, 33*b* on the other hand provides a mechanical barrier opposing dynamic infiltration of water, in other words infiltration of moving water (as is the case of rain driven by wind against a modular wall or double wall for example). It can additionally be noted that these mechanical barriers also make it possible to substantially limit infiltration of air.

Additionally, and according to one essential characteristic of the invention, the clearances between the projections 3*a*, 3*a'*, 203*a*, 203*a*, and the channels 3*b*, 3*b'* on the one hand, and between the zigzag-shaped portions 33*a*, 33*b* on the other hand, make it possible to create regions of separation between modular elements inside of which water can barely progress by capillarity. This can thereby constitute a physical barrier against water infiltration.

It should be noted that these clearances should be sufficiently large to avoid water being able, thanks to surface tension, to simultaneously remain in contact with the facing portions of two adjacent modular elements, and so advance by capillarity. Various tests have shown that, in practice, clearances of at least 2 mm are suitable It will additionally be noted that the use of a material such as waterproof concrete makes it possible to limit water infiltration by impregnation. Similarly, chemical barriers against infiltration of water are formed.

Given that these various sealing barriers act over a certain depth of a modular walls or half wall, it is appropriate to provide means for collecting water inside the wall or double wall.

This is the function of the hollows 25, 26, 125, 125', 126, 126', 225, 226 and intermediate cavities 30, 230 which make it possible, thanks to the straight or staggered stacking described above, to form water flow channels towards the foot of the walls or double walls.

The tapering of these hollows and cavities towards the base of the modular elements makes it possible to create an effect whereby the water is obliged to trickle always against the two walls of the acute dihedron formed by the lower edges of these hollows and cavities, thereby avoiding water returning by capillarity between the flat lands of modular elements of rows situated at a lower level.

Apart from the fact that the horizontal grooves 20, 20', 120, 120', 220, 220' and vertical grooves 40*a*, 40*a'*, 40*a"*, 40*b*, 40*b'*, 40*b"* form additional obstacles to horizontal and vertical water infiltration, they make it possible to channel the water towards the hollows 25, 26, 125, 125', 126, 126', 225, 226 and towards the intermediate cavities 30, 230.

Additionally it should be borne in mind that the modular elements according to the invention are primarily intended to remain visible at least from the outside. Thus, factors contributing to their aesthetic appeal are primordial.

The optional horizontal chamfers 16, 16' and the vertical chamfers 36*a*, 36*b* make it possible to highlight the lines of join between modular elements, and thereby create a visual pattern on walls or double walls constructed.

The use of architectural grade concrete makes it possible to adapt the outside appearance of the walls or double walls to architectural constraints applying at those places where they are to be built.

Finally, it could be noted that, apart from the fact that the clearances (J; J') discussed above make it possible to resolve problems of sealing of modular walls or double walls, they additionally make it possible to improve the behavior of such walls or double walls under certain abnormal conditions. Thus, in case of fire, these clearances make it possible to take up the expansion of the modular elements, associated with a considerable increase in temperature, thereby avoiding them splitting into pieces.

In the case of earthquake, these clearances make it possible to absorb part of the energy transmitted to the wall or double wall by the ground, thereby avoiding premature destruction.

Obviously, the invention is not limited to the embodiment described and shown which has been provided as an illustrative example which is not limiting.

In particular, the invention extends to other specific modular elements necessary for providing special elements such as half-modular elements for providing window frames, and L-shaped modular anchoring elements for providing floors, etc.

We claim:

1. A modular element for dry assembly of a wall or double wall comprising:

an upper face with a substantially flat internal surface disposed between longitudinal projections that extend a length of the modular element, wherein the projections extend above the internal flat surface and comprise an inclined flank and a horizontal flank;

an opposite lower face with substantially flat surface with longitudinal channels that extend a length of the modular element, wherein the projections form a mortarless union with the channels as the modules are stacked to form the wall or the double wall;

end faces adapted to form an interlocking arrangement with adjacent modular elements, wherein each end face has at least one substantially flat surface, at least two tenons, and at least two mortises to provide an interlocking arrangement with the adjacent modular elements;

one or more cavities extending from the upper face to the lower face; and one or more channels proximate to the upper face, wherein the channels are connected to the one or more cavities to minimize horizontal infiltration of water through the wall, and to direct water to the one or more cavities, and wherein the one or more cavities include an opening that extends from one channel proximate to the upper face, across the upper face, to an opposite channel proximate to the upper face.

2. The modular element of claim 1, wherein the opening in the cavities that extend across the upper face have a radius of curvature at the corners greater than 35 mm.

3. A modular element for dry assembly of a wall or double wall comprising:

an upper face with a substantially flat internal surface disposed between longitudinal projections that extend a length of the modular element, wherein the projections extend above the internal flat surface and comprise an inclined flank and a horizontal flank;

an opposite lower face with substantially flat surface with longitudinal channels that extend a length of the modular element, wherein the projections form a mortarless union with the channels as the modules are stacked to form the wall or the double wall; and end faces adapted to form an interlocking arrangement with adjacent modular elements, wherein each end face has at least one substantially flat surface, at least two tenons, and at least two mortises to provide an interlocking arrangement with the adjacent modular elements, and wherein the mortise and the tenon are trapezoidally-shaped, and ensure guiding of the modular element at the time of assembly, to maintain the modular element in place once assembled, and to form a mechanical barrier against dynamic vertical infiltration of water and air, and wherein the flat surface of the end face abuts a flat end surface of an adjacent modular element during assembly, wherein the abutment of flat end surfaces of adjacent modular elements provide a gap between a top surface of the tenon and a bottom surface of the mortise.

4. The modular element of claim 3, wherein the gap is at least equal to 2 mm.

5. A modular element for dry assembly of a wall or double wall comprising:

an upper face with a substantially flat internal surface disposed between longitudinal projections that extend a length of the modular element, wherein the projections extend above the internal flat surface and comprise an inclined flank and a horizontal flank;

an opposite lower face with substantially flat surface with longitudinal channels that extend a length of the modular element, wherein the projections form a mortarless union with the channels as the modules are stacked to form the wall or the double wall; and end faces adapted to form an interlocking arrangement with adjacent modular elements, wherein each end face has at least one substantially flat surface, at least two tenons, and at least two mortises to provide an interlocking arrangement with the adjacent modular elements, and wherein the mortise and the tenon are trapezoidally-shaped, and ensure guiding of the modular element at the time of assembly, to maintain the modular element in place once assembled, and to form a mechanical barrier against dynamic vertical infiltration of water and air, and wherein the flat surface of the end face abuts a flat end surface of an adjacent modular element during assembly, wherein the tenon includes an interior channel and an exterior channel chat extends along both vertical sides, wherein the abutment of flat end surfaces of adjacent modular elements cause the interior channels of one modular element to align with the interior channel of an adjacent modular element.

* * * * *